US007898185B2

(12) United States Patent
Mojarradi et al.

(10) Patent No.: US 7,898,185 B2
(45) Date of Patent: Mar. 1, 2011

(54) CURRENT CONTROLLED DRIVER

(76) Inventors: Mohammad M. Mojarradi, La Canada, CA (US); Laurence P. Sadwick, Salt Lake City, UT (US)

( * ) Notice: Subject to any disclaimer, the term of this patent is extended or adjusted under 35 U.S.C. 154(b) by 405 days.

(21) Appl. No.: 12/168,123

(22) Filed: Jul. 5, 2008

(65) Prior Publication Data

US 2009/0009096 A1 Jan. 8, 2009

Related U.S. Application Data

(60) Provisional application No. 60/948,090, filed on Jul. 5, 2007.

(51) Int. Cl.
*H05B 37/02* (2006.01)

(52) U.S. Cl. ..... 315/209 R; 315/291

(58) Field of Classification Search ..... 315/209 R, 315/246, 276, 283, 291, 307
See application file for complete search history.

(56) References Cited

U.S. PATENT DOCUMENTS

| | | | | |
|---|---|---|---|---|
| 4,385,262 | A * | 5/1983 | Cambier et al. | 315/307 |
| 6,081,075 | A | 6/2000 | Littlefield | |
| 6,462,485 | B1 | 10/2002 | Kimball | |
| 6,563,274 | B2 * | 5/2003 | Suzuki et al. | 315/291 |
| 6,927,989 | B2 | 7/2004 | Fukumoto | |
| 7,151,246 | B2 | 8/2004 | Fein et al. | |
| 7,151,345 | B2 | 5/2005 | Sanchez | |
| 7,183,724 | B2 | 7/2005 | Ball | |
| 6,975,162 | B2 * | 12/2005 | Tamura et al. | 327/538 |
| 7,298,095 | B2 | 2/2006 | Nukisato et al. | |
| 7,330,053 | B2 * | 2/2008 | Brucke et al. | 326/83 |
| 2008/0081423 | A1 | 4/2008 | Sadwick et al. | |

* cited by examiner

*Primary Examiner* — Thuy Vinh Tran
(74) *Attorney, Agent, or Firm* — Hamilton, DeSanctis & Cha

(57) ABSTRACT

Various current controlled driver apparatuses are disclosed herein. For example, some embodiments of the present invention provide a current controlled driver including a control circuit having a current input and a driver circuit having a power input. The control circuit has an output that is directly electrically connected to an input of the driver circuit. The control circuit operates between a positive voltage level and a ground potential. The driver circuit is adapted to operate between a higher positive voltage level and a negative voltage level.

19 Claims, 2 Drawing Sheets

CURRENT CONTROLLED DRIVER

CROSS REFERENCE TO RELATED APPLICATION

The present application claims priority to (i.e., is a non-provisional of) U.S. Provisional Patent Application No. 60/948,090 entitled "Current Controlled Driver", and filed Jul. 5, 2007 by Mojarradi et al. The aforementioned application is assigned to an entity common hereto, and the entirety of the aforementioned application is incorporated herein by reference for all purposes.

BACKGROUND OF THE INVENTION

The present invention is related to current controlled drivers, and more particularly to a current controlled driver having a low voltage control circuit directly coupled to a high voltage capable controlled AC driver circuit.

There are a number of methods and techniques that have been developed for controlling the current through loads such as fluorescent lamps (FLs) including compact fluorescent lamps (CFLs) and cold cathode fluorescent lamps (CCFLs) that use one or more transformers for multiple lamps. Some of these methods control the current through the FL, CFL or CCFL from the primary side while others control from the secondary side. Control of the secondary side typically includes rectifying the alternating current (AC) from the transformer into a direct current (DC) using a bridge rectifier similar to a conventional AC to DC power supply (for example see U.S. Pat. No. 7,183,724, "Inverter with Two Switching Stages for Driving Lamp", U.S. Pat. No. 6,462,485, "EL Driver for Small Semiconductor Die", U.S. Pat. No. 6,927,989, "DC-AC Converter and Controller IC for the Same", U.S. Pat. No. 7,298,095, "Discharge Lamp Ballast Apparatus", and U.S. Pat. No. 6,081,075, "DC To AC Switching Circuit For Driving An Electroluminescent Lamp Exhibiting Capacitive Loading Characteristics"). Such methods and approaches require very careful balancing or blocking of the DC current such that there is no net DC current flowing through the FL, CFL or CCFL as a DC current component can greatly reduce the life of the FL, CFL or CCFL. Control of AC methods often require isolation of the control circuitry on the primary side (low) voltage potential which is referenced to ground (zero) potential from the secondary (high) side in which the electronics may be floating and not directly tied to ground potential. For example, such isolation can consist of using an opto isolator and/or opto coupler as is required in U.S. Pat. No. 7,151,345, "Method And Apparatus For Controlling Visual Enhancement Of Luminent Devices" and U.S. Pat. No. 7,151,246, "Method And Apparatus For Optimizing Power Efficiency In Light Emitting Device Arrays" in which complex digital algorithms are used and require the use of, for example, field programmable logic arrays (FPGAs) to interface to various control blocks including isolated read and sense units via opto-isolators.

Furthermore optocouplers/optoisolators are often relatively expensive for such an application as multiple CCFLs and are not amenable to incorporation and monolithic inclusion into integrated circuit (IC) approaches and need to use opto-isolation or other such non-IC integration approaches as external components to the ICs.

Thus, for at least the aforementioned reason, there exists a need in the art for improved current controlled drivers.

BRIEF SUMMARY OF THE INVENTION

The present invention is related to current controlled drivers, and more particularly to a current controlled driver having a low voltage control circuit directly coupled to a high voltage AC driver circuit.

Various current controlled driver apparatuses are disclosed herein. For example, some embodiments of the present invention provide a current controlled driver including a control circuit having a current input and a driver circuit having an AC or DC switched power input. The control circuit has an output that is directly electrically connected to an input of the driver circuit. The control circuit operates between a positive voltage level and a ground potential. The driver circuit is adapted to operate between a higher positive voltage level and a negative voltage level.

In other instances of the aforementioned current controlled driver, the driver circuit includes a diode bridge having four legs connected at a common cathode node, a common anode node, a first cathode-anode node and a second cathode-anode node. The first cathode-anode node is connected to the ground potential and the second cathode-anode node is connected to a load. The second cathode-anode node is connected to the load at a first connection on the load, the driver circuit further including a transformer having a first connection of a first winding connected to a load at a second connection on the load and having a second connection of the first winding connected to the ground potential, wherein a second winding of the transformer is connected to the power input.

In various cases, the current controlled drivers further include a current mirror connected between the common cathode node and the common anode node of the diode bridge, the current mirror having an input connected to the input of the driver circuit. The driver circuit can also include a stacked transistor array connected in series with a slave transistor of the current mirror in the driver circuit.

Other embodiments of the present invention provide current controlled drivers including a control circuit, a protection diode having an anode connected to the output of the control circuit, and a driver circuit having an input connected to the cathode of the protection diode. The control circuit includes a current DAC, a first current sinking mirror having an input connected to the input of the control circuit. The control circuit also includes at least one stacked transistor connected in series between an output of the first current sourcing mirror and an output of the control circuit. The control circuit further includes a protection diode having an anode connected to the output of the control circuit. The driver circuit includes a second current sinking mirror having an input connected to a cathode of the protection diode and a second at least one stacked transistor connected in series with a drain of the second current sinking mirror. The driver circuit also includes a diode bridge having a common anode node connected to a source of the second current sinking mirror, a common cathode node connected to a drain of the second at least one stacked transistor, a first cathode-anode node connected to a ground, and a second cathode-anode node connected to a first connection of a load. The driver circuit of this embodiment further includes a capacitor having a first input connected to a second connection of the load and a transformer having a first tap of a first winding connected to a second input of the capacitor and a second tap of the first winding connected to the ground, and having a first tap and a second of a second winding connected to a power supply.

This summary provides only a general outline of some embodiments according to the present invention. Many other objects, features, advantages and other embodiments of the present invention will become more fully apparent from the following detailed description, the appended claims and the accompanying drawings.

BRIEF DESCRIPTION OF THE DRAWINGS

A further understanding of the various embodiments of the present invention may be realized by reference to the figures which are described in remaining portions of the specification. In the figures, like reference numerals may be used throughout several drawings to refer to similar components.

DETAILED DESCRIPTION OF THE INVENTION

The drawings and description, in general, disclose various embodiments of a current controlled driver having a low voltage digital control circuit directly connected to a high voltage AC driver circuit for loads such as a cold cathode fluorescent lamp. (Note, however, that the current controlled driver is not limited to use with any particular type of load, or at any particular voltage level or frequency.) The current controlled driver may be embodied in a single CMOS integrated circuit and/or package if desired. One or more protection diodes are included between the control circuit and the driver circuit to prevent damage to the low voltage digital control circuit. Transistors may be stacked in the control circuit and driver circuit to obtain the desired voltage levels without damaging transistors, as disclosed in U.S. patent application Ser. No. 11/541,429 of Laurence P. Sadwick et al., filed Sep. 29, 2006, entitled "Processes and Packaging for High Voltage Integrated Circuits, Electronic Devices, and Circuits", which is incorporated herein by reference for all that it contains. The driver circuit, although coupled to the control circuit, is capable of operating at very high voltages and at voltages below ground.

The inventive approach taken here is to design a current control that can be fully integrated into an IC while still allowing full control functions. These control functions can be analog, digital or a mixture of both. The control functions can be stand alone or part of a more complex analog/digital control approach. By being able to be stand-alone and analog, digital or both analog and digital, a number of low cost and power efficient implementations are possible and enabled again with the possibility of being fully monolithically integrated into an IC with the capability to drive one to n (where n could be anywhere from 2 to over 200) CCFLs, CFLs, or FLs.

Figure 1:
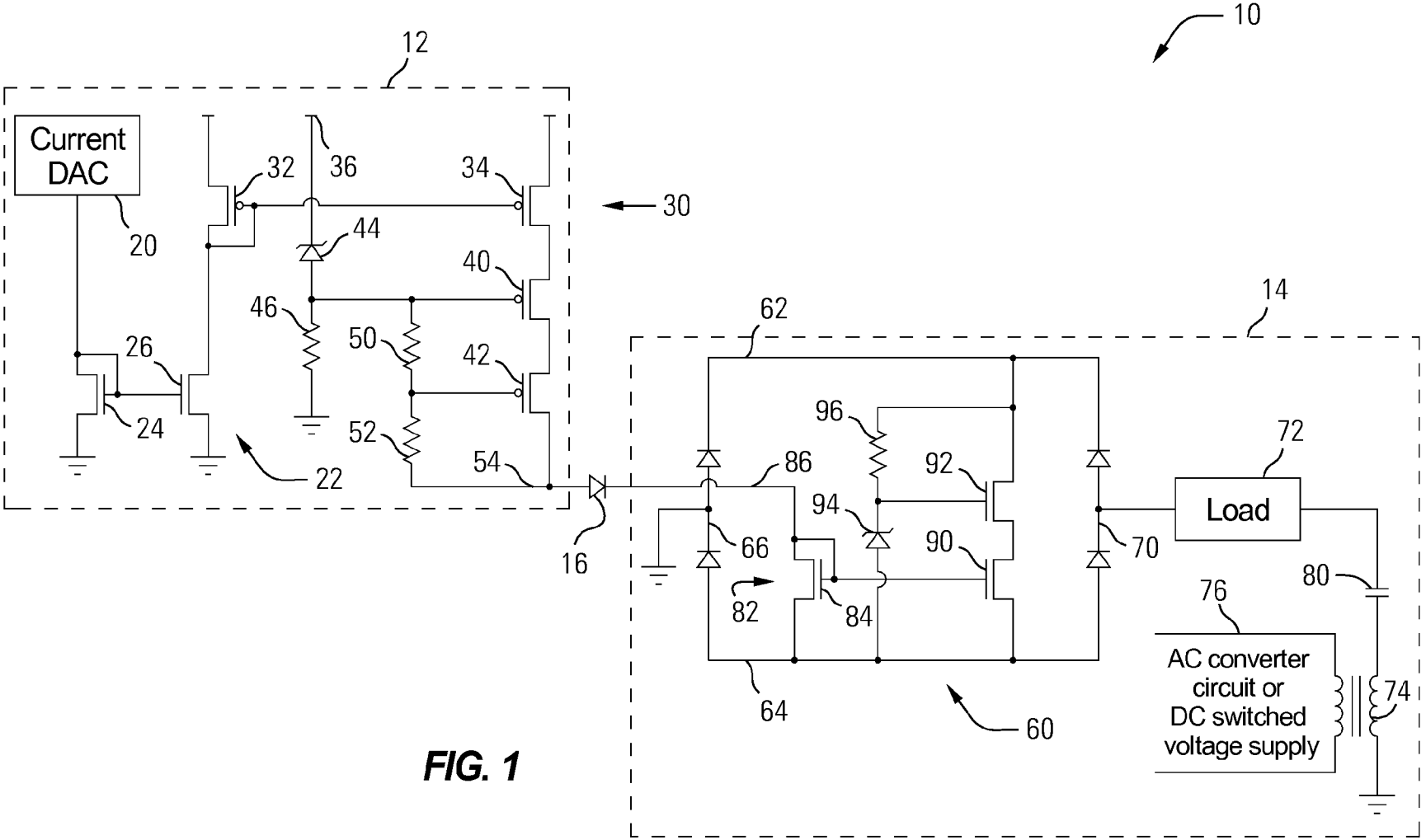
FIG. 1 depicts a current controlled driver in accordance with some embodiments of the present invention.

Referring now to FIG. 1, one particular embodiment of a current controlled driver 10 is illustrated. FIG. 1 shows an exemplary circuit of the present invention for the high voltage AC lamp current control source with the understanding that the present invention can also be applied to high voltage DC circuits. This circuit shown in FIG. 1 works as a current source supplying a lamp with constant current while the high voltage AC is applied across the lamp. In FIG. 1, a digital control circuit 12 is directly connected to an AC driver circuit 14 via a protection diode 16. The control circuit 12 has a current input connected to a variable current source such as a current D/A converter 20. The current D/A converter 20 is connected to a current mirror 22 that provides a reference current. In one particular embodiment, the current mirror 22 is a current sinking mirror having a master NMOS transistor 24 with the gate and drain connected to the current D/A converter 20 and the source connected to ground. The gate of the master NMOS transistor 24 is also connected to the gate of a slave NMOS transistor 26. The source of the slave NMOS transistor 26 is connected to ground, and the drain is connected to a second current mirror 30. The current D/A converter 20 and current mirror 22 are referenced to the ground potential and may be designed and integrated through classical use of transistors. The current D/A converter 20 can be integrated with the current mirror 22 and other components in a single CMOS integrated circuit if desired.

In one particular embodiment, the second current mirror 30 is a current sourcing mirror having a master PMOS transistor 32 and a slave PMOS transistor 34 having their gates coupled together and to the drain of the master PMOS transistor 32. The drain of the master PMOS transistor 32 is connected to the drain of the slave NMOS transistor 26 in the first current mirror 22. The sources of the master PMOS transistor 32 and slave PMOS transistor 34 are connected to a positive DC supply voltage 36. The positive DC supply voltage 36 may be set at a positive low voltage DC low voltage level that would typically be used to power a digital control circuit, or may be set at higher voltage levels if desired. The drain end of the slave NMOS transistor 26 is connected to the control input of the driver circuit 14 and in operation may drop to negative high voltage levels. That is, the current mirror 30 operates as a PMOS high voltage current source that is capable of operating to negative high voltages of a diode bridge in the driver circuit 14 that may drop far below the ground potential.

To protect the slave NMOS transistor 26, a stacked array of high voltage PMOS transistors may be connected in series with the drain of the slave NMOS transistor 26 in one particular embodiment. Thus, the slave NMOS transistor 26 and each transistor in the stack handles a fraction of the high voltage that may be needed for a load such as a CCFL lamp. In the particular embodiment illustrated in FIG. 1, a pair of high voltage PMOS transistors 40 and 42 are connected in series with the slave NMOS transistor 26. The gate of the first high voltage PMOS transistor 40 is biased by a Zener diode 44 and resistor 46. The anode of the Zener diode 44 is connected to the gate of the high voltage PMOS transistor 40 and the cathode is connected to the positive DC supply voltage 36. The resistor 46 is connected at one end to the gate of the high voltage PMOS transistor 40 and at the other end to ground. The second high voltage PMOS transistor 42 (and others if more than two transistors 40 and 42 are included in the stack) are biased by a voltage divider network of matching resistors 50 and 52 connected at one end to the gate of the first stacked transistor 40 and at the other end to the output 54 of the control circuit 12. The resistor array evenly divides the voltage across the array. The gate of individual PMOS transistors (e.g., 40 and 42) are connected to each resistor respectively, therefore the drain to gate voltage of each stacked PMOS transistor (e.g., 40 and 42) respectively sees that same potential that is across each of the resistors. This potential is a fraction of the total voltage and is defined by the number of the resistors. The number of stacked transistors (e.g., 40 and 42) and resistors (e.g., 50 and 52) may be determined by the maximum voltage divided by the maximum operating voltage of each PMOS transistor (e.g., 40 and 42). Thus each transistor can safely operate near its maximum safe operating voltage. Advanced packaging techniques such as those disclosed in the "Processes and Packaging for High Voltage Integrated Circuits, Electronic Devices, and Circuits" document referenced above may be used to isolate the substrate of each PMOS transistor 40 and 42 and ensure its proper operation. The drain of the last stacked transistor 40 in the PMOS high voltage current source is also connected to the output 54 of the control circuit 12. (Note that the stacked transistors may be biased in any suitable alternative way such as using diodes, active components, etc.)

The driver circuit 14 includes a diode bridge 60 having four legs separating four nodes, a common cathode node 62, a common anode node 64, a first cathode-anode node 66 and a second cathode-anode node 70. Each leg of the diode bridge 60 may include a single diode or multiple diodes as desired stacked in series and/or parallel, and may use passive diodes or any suitable device for restricting the direction of current flow. The first cathode-anode node 66 is connected to ground, and the second cathode-anode node 70 is connected to a load 72 such as a CCFL. The load 72 is also connected to a transformer 74 that acts as a source of high voltage current for the load 72. Two taps of one winding on the transformer 74 are connected to a DC switching source typically between 20 V DC and 400 V DC although lower and higher voltages could be used or an appropriate AC circuit power supply 76 such as from a standard 110 volt US residential wall outlet or designed, for example, to accept universal voltages from, say, 80 VAC to 270 V AC with or without power factor correction depending on the particular application. One tap of the second winding on the transformer 74 is connected to the load 72, and the other tap of the second winding is connected to ground. The load 72 may be connected to the transformer 74 through a capacitor 80 if desired to block DC current through the load 72, such as fluorescent lamps that may be damaged by a DC current or a DC current component.

The current through the load 72 is controlled by a current mirror 82 between the common cathode node 62 and common anode node 64 of the diode bridge 60. In one particular embodiment, the current mirror 82 is a current sinking mirror having a master NMOS transistor 84 connected in series with the to the PMOS high voltage current source of the current mirror 30. That is, the drain and gate of the master NMOS transistor 84 forms the input 86 of the driver circuit 14 and is connected to the output 54 of the control circuit 12 through the protection diode 16. The source of the master NMOS transistor 84 is connected to the common anode node 64 of the diode bridge 60. The gate of a slave NMOS transistor 90 is connected to the gate of the master NMOS transistor 84, and the source of the slave NMOS transistor 90 is connected to the common anode node 64 of the diode bridge 60. The current mirror 82 converts the current from the PMOS high voltage current source into a proper positive polarity suitable for the diode bridge 60. It may also include a stack of NMOS transistors to evenly divide the maximum high voltage of the load 72 into sections that are safe for operation of lower voltage NMOS transistors. For example, stacked NMOS transistor 92 may be connected in series with the slave NMOS transistor 90, with the source of the stacked NMOS transistor 92 connected to the drain of the slave NMOS transistor 90, and the drain of the stacked NMOS transistor 92 connected to the common cathode node 62. As with the PMOS high voltage current source, any number of transistor may be included in the stack. As one exemplary approach, the stacked NMOS transistor 92 is biased by a Zener diode 94 having the anode connected to the common cathode node 62 and the cathode connected to the gate of the stacked NMOS transistor 92, and by a resistor 96 having one end connected to the gate of the stacked NMOS transistor 92 and the other end connected to the common cathode node 62 of the diode bridge 60.

The protection diode 16 is connected between the control circuit 12 and the driver circuit 14, with the anode of the protection diode 16 connected to the output 54 of the control circuit 12 and the cathode of the protection diode 16 connected to the input 86 of the driver circuit 14. The protection diode 16 protects the current mirrors 22, 30 and 86 from over-voltage conditions and voltage or current spikes and/or surges and ensures that current will only flow in one direction from the control circuit 12 to the driver circuit 14.

Figure 2A:
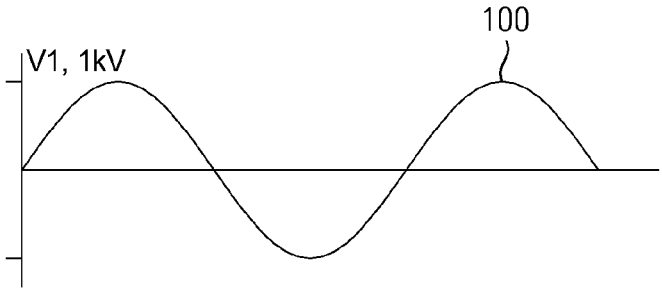
FIGS. 2*a*-2*f* are voltage and current diagrams showing plots of voltage and current versus time at various nodes in the circuit of FIG. 1.
Figure 2B:
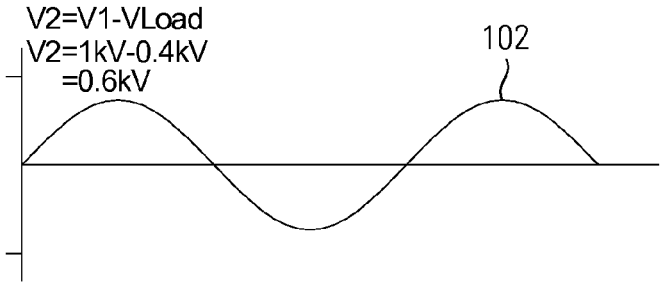
Figure 2C:
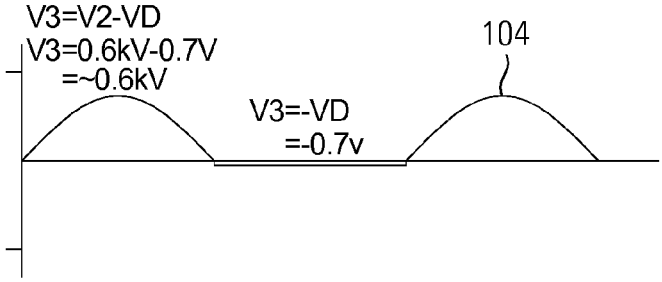
Figure 2D:
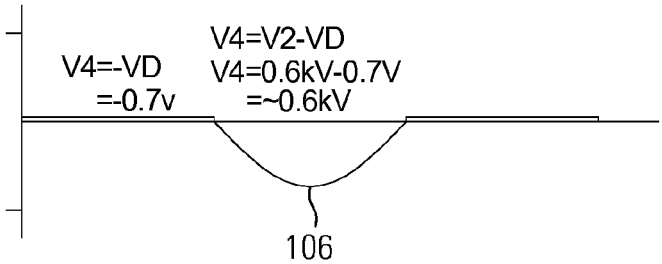
Figure 2E:
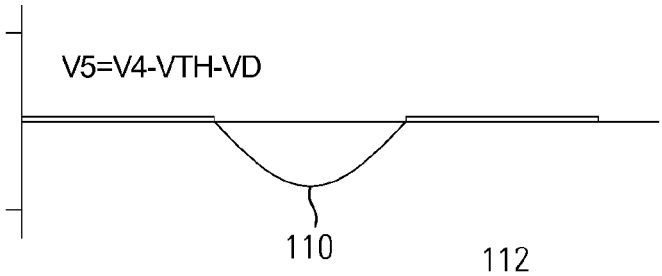
Figure 2F:
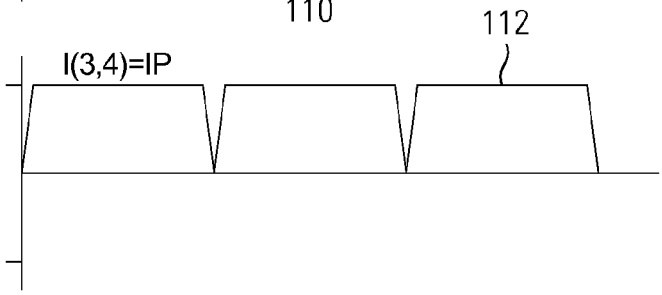

Referring now to FIGS. 2*a*-2*f*, the operation of the current controlled driver 10 will be described in more detail. The diode bridge 60 rectifies the sine wave of the AC current from the transformer 74 and load 72 and converts it to a unidirectional current that will be seen and controlled by the current mirror 82. The peak value of the current IP flowing from the common cathode node 62 to the common anode node 64 of the diode bridge 60 is controlled through the current mirror system, including the current mirrors 82, 30 and 22, as controlled by the current from the current D/A converter 20. The waveforms across the diode bridge 60 are shown in FIGS. 2*a*-2*f*. The voltage waveform 100 of FIG. 2*a* illustrates the AC voltage V1 at the input to the load 72. In one particular embodiment with a CCFL load 72, voltage V1 is about 1000 V although voltages much lower or much higher than 1000 V can be controlled and used in this inventive approach discussed here within. Voltage V2 102 illustrated in FIG. 2*b* is the voltage at the second cathode-anode node 70 of the diode bridge 60, and is equal to the voltage V1 at the input to the load 72 minus the voltage drop (e.g., 400 V) across the load 72. The voltage waveform 104 of FIG. 2*c* is the voltage V3 at the common cathode node 62 of the diode bridge 60, and is equal to a half wave rectified version of the voltage V2, minus the drop across the diode(s) between the common cathode node 62 and the second cathode-anode node 70. The voltage waveform 106 of FIG. 2*d* is the voltage V4 at the common anode node 64 of the diode bridge 60 and is the opposite of voltage V3. The voltage waveform 110 of FIG. 2*e* illustrates the voltage at the output 54 of the control circuit 12, which is equal to the voltage V4 minus the threshold voltage of the master NMOS transistor 84 and the voltage drop across the protection diode 16. The current IP 112 from the common cathode node 62 to common anode node 64 is illustrated in FIG. 2*f*. Note that the current IP 112 always flows in one direction because of the voltage drop from the common cathode node 62 to the common anode node 64 of the diode bridge 60, given the waveforms V3 104 and V4 106.

In one particular embodiment, transformer 74 generates 1000 Volts peak, for example, a sine wave which is applied to the CCFL 72 in series with ballast capacitor 82 that serves to regulate the voltage V1 across the CCFL lamp during the initial lighting of the lamp. Capacitor 82 may or may not be present or needed depending on the exact application for the present invention. The diodes of the diode bridge 60 direct the current through the lamp 72 in two different directions in each half cycle of the sine wave.

In other words, in one half cycle, the current enters from the bottom of the lamp 72 and leaves the lamp 72 from the top. In the next half cycle, the current flows in an opposite direction. Therefore, the circuit creates a bidirectional current through the lamp. The current mirror 82 controls the level of the bidirectional current as controlled by the control circuit 12. The protection diode 16 protects the system from any surge from the driver circuit 14 back to the control circuit 12, preventing destructive and potentially fatal damage to the overall CFL, FL or CCFL system.

In addition, techniques such as pulse width modulation (PWM) can be applied to the circuit with the protection diode 16 protecting the low voltage and/or ground potential referenced control circuitry 12. The PWM signal, for example, could be applied to the gate of master NMOS transistor 84 through the protection diode 16 and other components that are capable of providing a PWM signal. Note that typically the PWM signal need only be in the range of 5 to 30 volts maximum (i.e., 0 to 5 V, 0 to 15 V, etc.) to control the high side AC voltage in the range of 1000 s of volts. Should higher operating voltages be required on the high side (i.e., secondary side of the transformer) then stacking of the slave NMOS transistor 90 can be readily employed as described above to achieve operation voltages of up to 6000 volts and greater.

The current controlled driver 10 provides an effective and cost-effective current control device for loads such as a CCFL that can be integrated using a CMOS process. The current controlled driver 10 controls the current fed to the load 72 using transistors that are referenced to the ground potential. With a CCFL load, because the CCFL lamp current directly controls the light intensity, the current controlled driver 10 is able to control the lamp intensity by adjusting the current of the current D/A converter 20 instead of or together with traditional PWM based techniques for controlling the lamp. The current controlled driver 10 also enables the sharing of one single transformer 74 to power an array of lamps, each with a current controlled driver 10 independently controlling the light intensity of each lamp. (Each lamp would be connected at one connection to the single transformer 74, and each would be connected at the other connection to a dedicated current controlled driver 10 for each lamp 72.

In conclusion, the present invention provides novel systems, devices, methods and arrangements for current controlled drivers. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A current controlled driver comprising:

a control circuit having a current input; and a driver circuit having a power input, wherein the control circuit has an output that is directly electrically connected to an input of the driver circuit, and wherein the control circuit operates between a positive voltage level and a ground potential, and the driver circuit is adapted to operate between a higher positive voltage level and a negative voltage level, the driver circuit comprising a diode bridge having four legs connected at a common cathode node, a common anode node, a first cathode-anode node and a second cathode-anode node.

2. The current controlled driver of claim 1, wherein the control circuit is directly electrically connected to the driver circuit through a diode having an anode connected to an output of the control circuit and a cathode connected to the input of the driver circuit.

3. The current controlled driver of claim 1 comprising a CMOS integrated circuit.

4. The current controlled driver of claim 1, wherein the first cathode-anode node is connected to the ground potential and the second cathode-anode node is connected to a load.

5. The current controlled driver of claim 4, wherein the second cathode-anode node is connected to the load at a first connection on the load, the driver circuit further comprising a transformer having a first connection of a first winding connected to the load at a second connection on the load and having a second connection of the first winding connected to the ground potential, wherein a second winding of the transformer is connected to the power input.

6. The current controlled driver of claim 5, further comprising a capacitor connected between the second connection on the load and the first connection of the first winding on the transformer.

7. The current controlled driver of claim 1, the driver circuit further comprising a current mirror connected between the common cathode node and the common anode node of the diode bridge, the current mirror having an input connected to the input of the driver circuit.

8. The current controlled driver of claim 7, the driver circuit further comprising a stacked transistor connected in series with a slave transistor of the current mirror in the driver circuit.

9. The current controlled driver of claim 8, wherein the stacked transistor of the driver circuit is biased by a resistor connected between a gate and a drain of the stacked transistor and a Zener diode having a cathode connected to the gate of the stacked transistor and an anode connected to the common anode node of the diode bridge.

10. The current controlled driver of claim 7, the current mirror comprising a current sinking mirror.

11. The current controlled driver of claim 1, the current input being connected to a current D/A converter.

12. A current controlled driver comprising:

a control circuit having a current input; and a driver circuit having a power input, wherein the control circuit has an output that is directly electrically connected to an input of the driver circuit, and wherein the control circuit operates between a positive voltage level and a ground potential, and the driver circuit is adapted to operate between a higher positive voltage level and a negative voltage level, the control circuit comprising a current minor connected to the current input.

13. The current controlled driver of claim 12, the current mirror comprising a current sinking mirror.

14. The current controlled driver of claim 12, the control circuit comprising a second current minor connected to the current minor.

15. The current controlled driver of claim 14, the second current minor comprising a current sourcing mirror.

16. The current controlled driver of claim 15, wherein the second current minor is connected to a voltage supply at a first end and to the output of the control circuit at a second end through at least one stacked transistor.

17. The current controlled driver of claim 16, the at least one stacked transistor being biased by a Zener diode having a cathode connected to the voltage supply and an anode connected to a gate of a first transistor in the at least one stacked transistor, and by a resistor connected at a first end to the gate of the first transistor in the at least one stacked transistor and at a second end to the ground potential.

18. The current controlled driver of claim 17, the at least one stacked transistor comprising at least two stacked transistors, a second transistor in the at least one stacked transistors being biased by a second resistor connected at a first end to the gate of the first transistor and at a second end to a gate of the second transistor, and by a third resistor connected at a first end to the gate of the second transistor and at a second end to the output of the control circuit.

19. A current controlled driver comprising:

a control circuit comprising:

a current DAC;

a first current sinking mirror having an input connected to the current DAC;

a first current sourcing mirror having an input connected to an output of the first current sinking mirror;

at least one stacked transistor connected in series between an output of the first current sourcing mirror and an output of the control circuit;

a protection diode having an anode connected to the output of the control circuit; and a driver circuit comprising:

a second current sinking minor having an input connected to a cathode of the protection diode;

a second at least one stacked transistor connected in series with a drain of the second current sinking minor;

a diode bridge having a common anode node connected to a source of the second current sinking mirror, a common cathode node connected to a drain of the second at least one stacked transistor, a first cathode-anode node connected to a ground, and a second cathode-anode node connected to a first connection of a load;

a capacitor having a first input connected to a second connection of the load; and a transformer having a first tap of a first winding connected to a second input of the capacitor and a second tap of the first winding connected to the ground, and having a first tap and a second of a second winding connected to a power supply.

* * * * *